US006817047B2

(12) United States Patent
Brodeur

(10) Patent No.: US 6,817,047 B2
(45) Date of Patent: Nov. 16, 2004

(54) COLLAPSIBLE COT WITH WALL MEMBERS

(76) Inventor: Catherine A. Brodeur, 11 Wintermute Farm La., Lebanon, NJ (US) 08833

( * ) Notice: Subject to any disclaimer, the term of this patent is extended or adjusted under 35 U.S.C. 154(b) by 609 days.

(21) Appl. No.: 09/770,302

(22) Filed: Jan. 26, 2001

(65) Prior Publication Data

US 2002/0100117 A1 Aug. 1, 2002

(51) Int. Cl.[7] ..... A47C 17/00; A47C 17/64
(52) U.S. Cl. ..... 5/110; 5/114
(58) Field of Search ..... 5/110, 111, 114, 5/116, 117, 113, 425, 427, 95

(56) References Cited

U.S. PATENT DOCUMENTS 2,672,627 A * 3/1954 Hagelfeldt ..... 5/114
3,965,502 A * 6/1976 Bertram ..... 5/111
5,749,112 A * 5/1998 Metzler ..... 5/424
5,860,175 A 1/1999 Saiki
6,151,730 A 11/2000 Weston

* cited by examiner

*Primary Examiner*—Heather Shackelford
*Assistant Examiner*—Lisa M. Saldano
(74) *Attorney, Agent, or Firm*—Kenneth P. Glynn, esq.

(57) ABSTRACT

The present invention is a collapsible cot with wall members, which includes a base frame, having an open position for use and a collapsed position for storing and transporting, with a footprint to support base flexible sheet material of an area sufficient to support a reclining human at least the size of a young child, and being collapsible so as to reduce its footprint by at least one half. Legs are collapsibly connected to the base frame, and a flexible sheet material is attached to the base frame to support at least a young child. There are at least two collapsible side walls, one each on opposite sides of the base frame, which include flexible sheet material and collapsible wall support mechanism, either hingeably or removably connected to the base frame.

12 Claims, 3 Drawing Sheets

COLLAPSIBLE COT WITH WALL MEMBERS

BACKGROUND OF THE INVENTION

1. Field of the Invention

The present invention relates to collapsible cots and, more particularly, to collapsible cots with side wall members. The side wall members act both as barriers and as surfaces for decoration, such as theme design applications. The present invention cots may be utilized for camping, for sleepovers, or for any other resting or bedding purpose, and are particularly useful as an intermediate bed for transition between cribs and normal beds. The present invention collapsible cots may be constructed in a full adult size but are most advantageous in smaller versions for younger children. They are collapsible, foldable, portable and are conveniently transported and stored.

2. Information Disclosure Statement

The following patents are representative of the collapsible cot prior art:

U.S. Pat. No. 5,860,175 describes a portable cot that consists of tubular framework that supports a cloth bed on the perimeter. The framework and bed is suspended from above by hanging webbing. The tubular members of the framework are connected together by hinges that allow the framework to be folded into a small bundle of tubes. The hinges and webbing are arranged so that framework is locked into a rigid bed when weighted and yet is allowed to fold when unweighted.

U.S. Pat. No. 6,151,730 describes an adjustable collapsible cot which can be utilized in numerous situations including evacuations and military operations. The cot includes an outer frame member and an inner frame member which are both preferably divided into two sections and are both pivotable approximate their center point. Either section of the inner frame member can be adjusted to one or more elevation angles with respect to the outer frame member as desired by the user. A spring loaded webbing material is provided to safely support and cradle the user. Preferably, a mattress is provided and is disposed on top of the spring loaded webbing. One or more restraint belts can be provided to safely secure the user while he or she is utilizing the cot. Several accessories items, including an intervenes pole, message flag and miscellaneous item bag/compartment can be provided and attached to the cot. When it is desired to move the cot, the cot can-be folded into an easily transportable configuration.

Notwithstanding the prior art, the present invention is neither taught nor rendered obvious thereby.

SUMMARY OF THE INVENTION

The present invention is a collapsible cot with wall members. These wall members are at least side wall members and act both as barriers and surfaces for decoration. The present invention cot includes a base frame having an open position for use and a collapsed position for storing and transporting. The base frame in its open position has a footprint sufficient to support flexible sheet material of an area sufficient to support a reclining human at least the size of a young child. The base frame and base flexible sheet material establishes a generally rectangular perimeter with sides and ends, when in its open position. The base frame is collapsible so as to reduce its footprint to at least one half its open position footprint when in its collapsed position. The cot includes a plurality of legs collapsibly connected to the base frame, and these legs have an open position for supporting the base frame, and a collapsed position for storing and transporting. There is flexible sheet material attached to the base frame of a size sufficient to support a reclining human at least the size of a young child. The flexible sheet material may be woven or unwoven and may be synthetic or natural. Preferred materials are canvas and nylon.

In the present invention device, there are at least two collapsible side walls, one each on opposite sides of the base frame. These collapsible side walls include a flexible sheet material and collapsible wall support means. The collapsible wall support means is connected to the base frame, and has an open position for supporting the side walls flexible sheet material, in an upright position, and has a collapsed position for storing and transporting. In some embodiments, the side wall members are continuations of the sheet material attached to the base frame, i.e., the user support material. In some other embodiments, the side wall members are separate pieces. On other embodiments, there are also end wall members, i.e., top and bottom endwalls.

In some preferred embodiments, the base frame is divided into at least two sections, two of which are pivotably connected to one another. The base frame is typically constructed predominantly of material selected from the group consisting of metal, plastic, wood and combinations thereof. It could be made of any available material which will support the weight of at least a child. The legs may be hingeably and permanently connected to the base frame, or may be removable for collapsing. In some embodiments where the legs are removable, they may be u-shaped members, with the base frame having a plurality of receiving orifices for insertion of ends of the u-shaped members.

As mentioned, the wall members have support means to maintain an upright position. Thus, the collapsible wall support means may be a plurality of rigid elongated members selected from members hingedly and permanently connected to the base frame, and members removably connectable to the base frame. These support means could be rods, pegs, upwardly hinged legs, u-shaped wall support members or the like.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
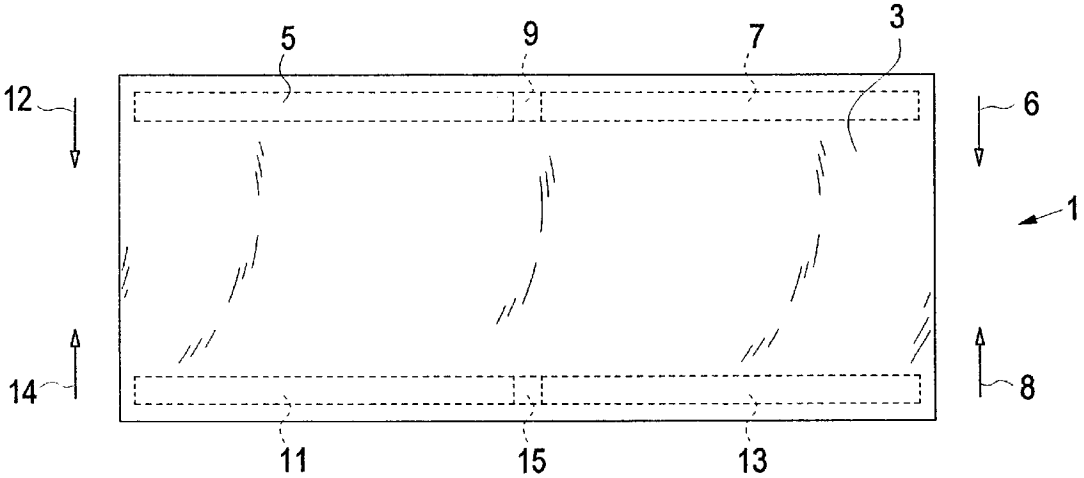
FIG. 1 PRIOR ART
FIGS. 1 and 2 illustrate a top and side view of a prior art collapsible cot.
Figure 2:
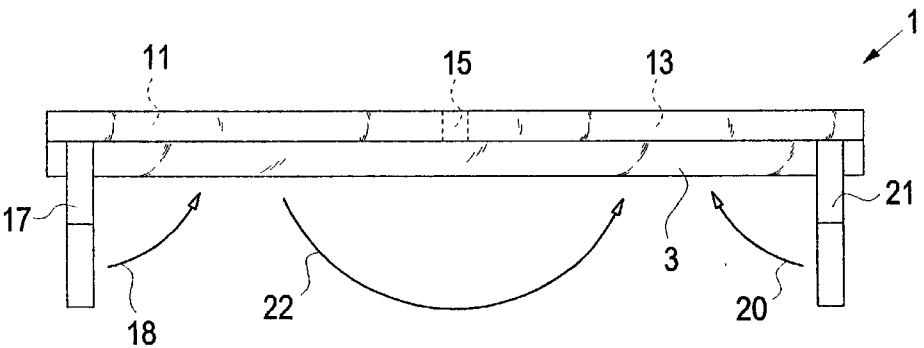
FIG. 2 PRIOR ART

FIG. 1 shows a top view and FIG. 2 shows a sideview of a prior art collapsible sleeping cot 1. It includes a base frame made of parallel wooden sections which are divided into hingedly wooden sections 5 and 7 and hingedly wooden sections connected to wooden sections 11 and 13. Legs 17 and 21 are crisscrossed with a central pivot point so that they could be closed up and additionally are attached to the wooden sections with hinges so that they could be folded inwardly as shown by arrows 18 and 20 in FIG. 2. Likewise, hinges 9 and 15 connect wooden sections 5, 7, 11 and 13, respectively, so that they may be folded downwardly toward one another as shown by arrow 22 in FIG. 2. Flexible sheet material 3 is made of canvas but can be made of any woven or non-woven flexible sheet material because flexible sheet material 3 is flexible opposite wood section may be moved toward one another as shown by arrows 6 and 8, and 12 and 14 of FIG. 1

Thus, FIGS. 1 and 2 show a typical prior art cot which may be folded to one half its length, a small fraction of its height and less than one quarter of its width. The present invention cots may utilize features similar to those shown in FIGS. 1 and 2, but include additional significant features created by opposite wall described above.

Figure 5:
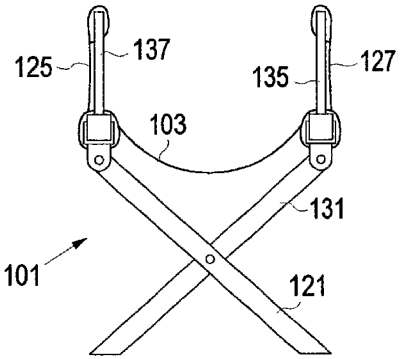
FIGS. 3, 4, and 5 illustrate a top, side and end view of a present invention collapsible cot.
Figure 3:
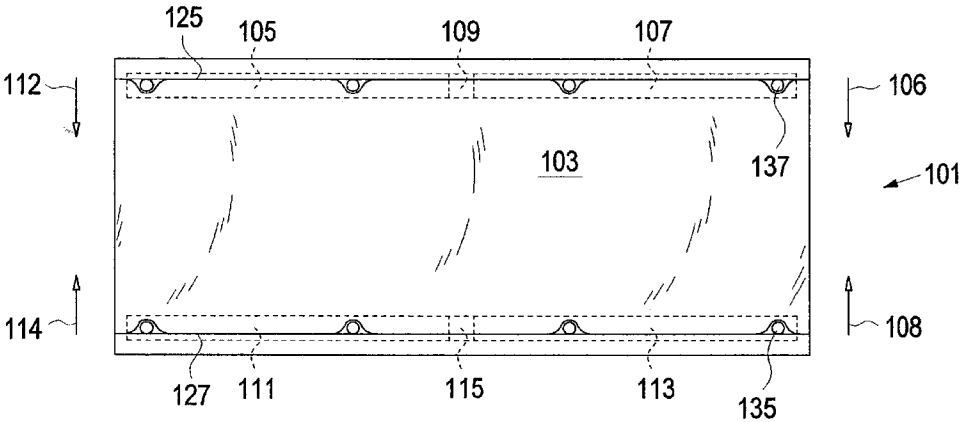
Figure 4:
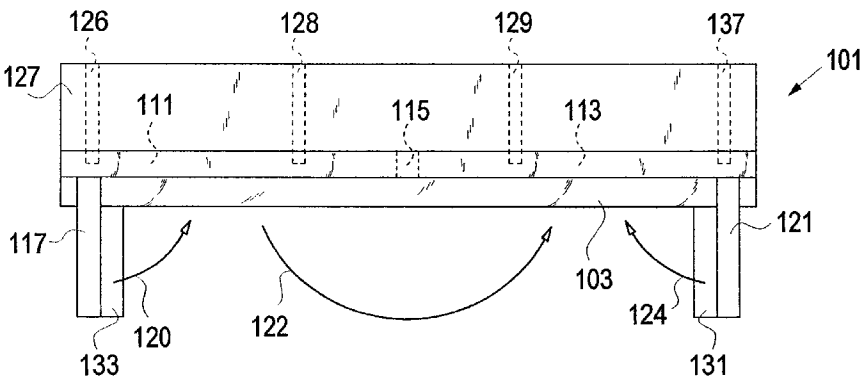

FIGS. 3, 4 and 5 show top, side and end views of one embodiment of a present invention cot. It includes a base frame comprised of four hollow aluminum sections 105 and 107 on one side, and, 111 and 113 on the opposite side. Hinges 109 and 115 connect these segments respectively. These hinges permit downward folding-as shown by arrow 122 in FIG. 4, but do not permit upward folding. This prevents collapse during use. Present invention side walls 125 and 127 are vertically upright in these 3 figures and are maintained in that position with blunted aluminum dowels, such as dowel 126, 128, 129 and 137. Foldable legs 117, 133, 121 and 131 are hingeably attached to the base frame hollow aluminum sections so as to be rotated inwardly in accordance with arrows 120 and 124 shown in FIG. 4. Flexible sheet material 103 is attached to the base frame (with appropriate orifices for legs and dowels), by that welding, stitching, riveting or any other available attachment arrangement. Because flexible sheet material 103 is flexible, opposite base frame sections may be folded toward one another in accordance with arrows 106, 108, 112, and 114 sidewalls 125 and 127 are maintained in an upward, open position via dowels, such as those mentioned above, and, specifically, blunted aluminum dowels 135 and 137 shown as the end dowels and emphasize in FIG. 5. The top of the dowels are inserted at their bottoms in orifices created in the base frame members and at their tops, at sleeves made from flexible sheet sidewalls.

Figure 6:
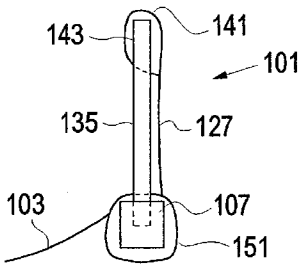
FIG. 6 illustrates a detail of a side wall support means.

FIG. 6 shows a partial side view in more detail of present invention 101, with identical parts from FIGS. 3, 4 and 5 identically numbered. Here, detail is shown with dowel 135 being inserted at its top into sleeve 143 of sidewall 127. This sleeve 143 is created by folded over section 141 of sidewall 143 and sealed to the main portion of the sidewall, except at that location which is intended to receive the dowel. Additionally, FIG. 6 also illustrates the corner seam of flexible sheet material of 103. Specifically, sheet 103 extends over sidewall 127, and includes a portion wrapped around base frame member 107. Thus, in this embodiment, the sidewall and the horizontal flexible sheet material are not only made of the same material, such as nylon, but are established, continuous sheet. Alternatively, they could be separate pieces, made of the same or different materials.

Figure 7:
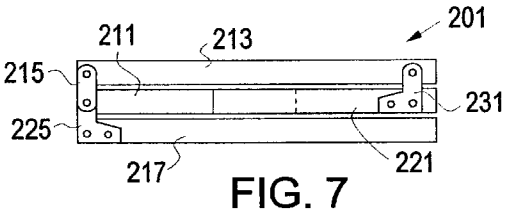
FIGS. 7 through 13 illustrate another preferred embodiment of a present invention collapsible cot with side wall.

FIG. 7 shows how a present invention cot 201 folded and thus, illustrates a device similar to cot 101 shown above, and with the flexible material removed to illustrate the functionality of the base frame and legs. Thus, base frame members 213 and 217 are folded inwardly towards each other with appropriate hinging, such as hinge 225, and legs, such as legs 211 and 221 likewise being folded inwardly with hinges such as hinges 215 and 231.

Figure 10:
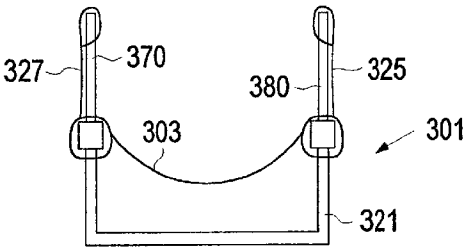
Figure 11:
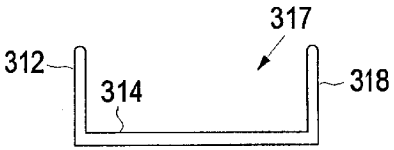
Figure 12:
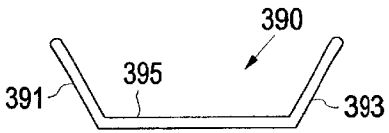
Figure 8:
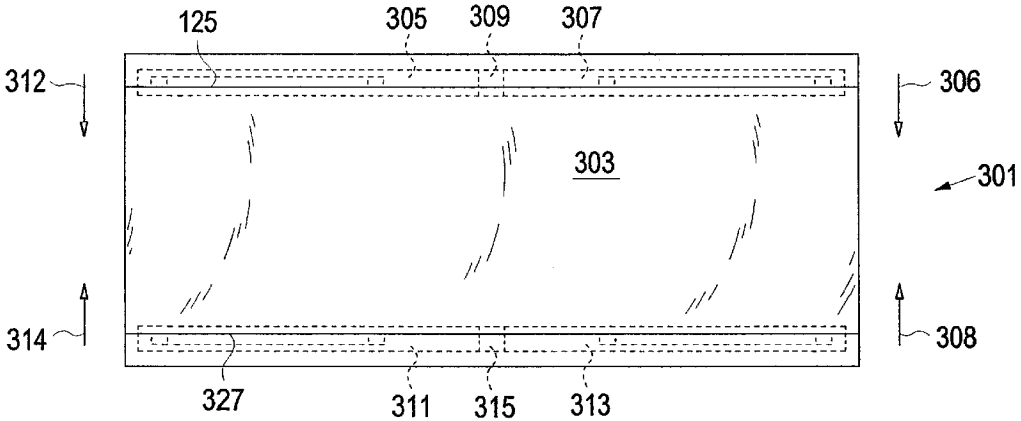
Figure 9:
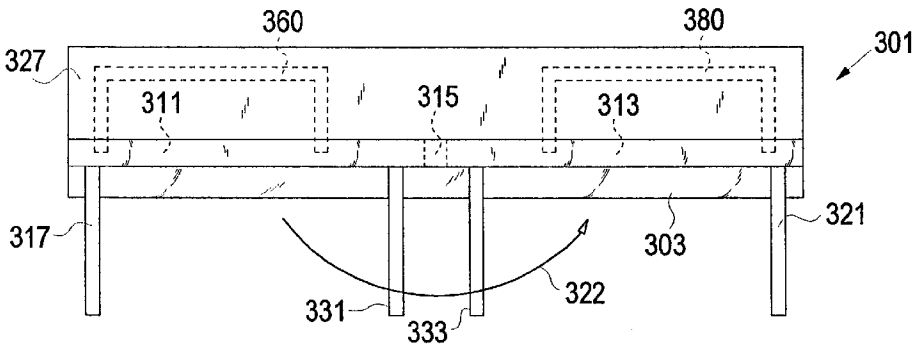

FIGS. 8, 9 and 10 show another embodiment of a present invention device, namely cot 301. It includes a base frame with hinges made of segments 305, 357, 301 and 313 with hinges 309 and 315. There is a base flexible sheet material 303 and removable legs 317, 321, 331 and 333. These removable legs are made of metal or high strength plastic and are u-shaped. These legs may be formed with horizontal and vertical segments, as shown in FIG. 11 or with obtuse angle segments as shown in FIG. 12. Folding my occur in accordance with arrows 306, 308, 312 and 314 shown in FIG. 8, and arrow 322 shown in FIG. 9. Sidewalls 325 and 327 are maintained in their open, upright position by inverted u-shaped supports such as support 360, 370 and 380 shown in FIGS. 9 and 10. They may be inserted into orifices in the base frame. The sidewalls may be attached by velcro, snap, sleeve or otherwise.

Figure 13:
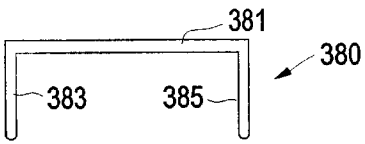

FIGS. 11, 12 and 13 illustrate the u-shaped legs, the obtuse angle u-shaped legs and the inverted u-sidewall supports which may be used in the present invention. Thus, FIG. 11 shows leg 317 with horizontal segment 314 and insertable vertical segments 312 and 318. FIG. 12 shows leg 390 with horizontal segment 395 and outwardly extending side segments 391 and 393. These legs are insertable and removable from cot 301. Likewise, support 380 shown in FIG. 13 has horizontal segment 381 at its top and has downwardly projecting segment 383 and 385 for insertion into the base with cot 301.

Obviously, numerous modifications and variations of the present invention are possible in light of the above teachings. It is therefore understood that within the scope of the appended claims, the invention may be practiced otherwise than as specifically described herein.

What is claimed is:

1. A collapsible cot with wall members, which comprises:

(a) a base frame, said base frame having an open position for use and a collapsed position for storing and transporting, said base frame in its open position having a footprint sufficient to support flexible sheet material of an area sufficient to support a reclining human at least the size of a young child, said base frame being collapsible so as to reduce its open position footprint to at least one half when in its collapsed position, said base frame and a base flexible sheet material establishing a generally rectangular perimeter with sides and ends, when in its open position;

(b) a plurality of legs collapsibly connected to said base frame, and having an open position for supporting said base frame, and a collapsed position for storing and transporting, (c) a flexible sheet material attached to said base frame of size sufficient to support a reclining human at least the size of a young child; and, (d) at least two collapsible side walls, one each on opposite sides of said base frame, said collapsible side walls including a flexible sheet material and collapsible wall support means, said collapsible wall support means being connected to said base frame, and having an open position for supporting said side walls flexible sheet material, and a collapsed position for storing and transporting, said flexible sheet material of said walls being physical extensions of said flexible sheet material attached to said base frame.

2. The collapsible cot of claim 1 wherein said base frame is divided into at least two sections, two of which are pivotably connected to one another.

3. The collapsible cot of claim 1 wherein said base frame is constructed predominantly of material selected from the group consisting of metal, plastic, wood and combinations thereof.

4. The collapsible cot of claim 1 wherein said legs are hingedly and permanently connected to said base frame.

5. The collapsible cot of claim 1 wherein said legs are removably connectable to said base frame.

6. The collapsible cot of claim 5 wherein said legs are u-shaped members and said base frame has a plurality for receiving orifices of insertion of ends of said u-shaped members.

7. The collapsible cot of claim 1 wherein said flexible sheet material attached to said base is selected from synthetic and natural woven sheet material.

8. The collapsible cot of claim 7 wherein said flexible sheet material is canvas.

9. The collapsible cot of claim 1 wherein said collapsible side wall flexible sheet material is selected from synthetic and natural unwoven sheet material and synthetic natural woven material.

10. The collapsible cot of claim 9 wherein said collapsible side wall flexible sheet material is canvas.

11. The collapsible cot of claim 1 wherein said collapsible wall support means is a plurality of rigid elongated members hingedly and permanently connected to said base frame.

12. The collapsible cot of claim 1 wherein said collapsible wall support means a plurality of rigid elongated members removably connectable to said base frame.

* * * * *